US009240141B2

(12) United States Patent
Qing et al.

(10) Patent No.: US 9,240,141 B2
(45) Date of Patent: Jan. 19, 2016

(54) PIXEL UNIT DRIVING CIRCUIT, PIXEL UNIT DRIVING METHOD AND PIXEL UNIT

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Haigang Qing, Beijing (CN); Xiaojing Qi, Beijing (CN); Young Yik Ko, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 218 days.

(21) Appl. No.: 13/994,934

(22) PCT Filed: Nov. 2, 2012

(86) PCT No.: PCT/CN2012/084010

§ 371 (c)(1),
(2) Date: Jun. 17, 2013

(87) PCT Pub. No.: WO2013/127188

PCT Pub. Date: Sep. 6, 2013

(65) Prior Publication Data

US 2014/0078028 A1 Mar. 20, 2014

(30) Foreign Application Priority Data

Feb. 27, 2012 (CN) ..... 2012 1 0048571

(51) Int. Cl.
*G09G 3/32* (2006.01)

(52) U.S. Cl.
CPC ..... *G09G 3/3258* (2013.01); *G09G 3/3233* (2013.01); *G09G 2300/0861* (2013.01); *G09G 2320/0233* (2013.01); *G09G 2320/045* (2013.01)

(58) Field of Classification Search
CPC ..... G09G 3/3233; G09G 3/3258; G09G 2300/0861; G09G 2320/0233; G09G 2320/045
See application file for complete search history.

(56) References Cited

U.S. PATENT DOCUMENTS 7,872,620 B2 1/2011 Han et al.
2010/0127955 A1 5/2010 Choi (Continued)

FOREIGN PATENT DOCUMENTS

CN 101739950 A 6/2010
CN 102280085 A 12/2011
CN 102708794 A 10/2012

OTHER PUBLICATIONS

International Search Report mailed Jul. 2, 2013; PCT/CN2012/084010.

(Continued)

*Primary Examiner* — Kumar Patel
*Assistant Examiner* — Afroza Chowdhury
(74) *Attorney, Agent, or Firm* — Ladas & Parry LLP

(57) ABSTRACT

A pixel unit driving circuit, a pixel unit driving method and a pixel unit, which can improve the problems of OLED panel luminance uniformity and luminance decreasing caused by material aging. The pixel unit driving circuit includes a driving TFT (DTFT), a matching TFT (MTFT), a first switching element (11), a storage capacitor (Cs) and a driving control unit (12); the driving TFT (DTFT) has a gate connected to a first terminal of the storage capacitor (Cs), a source connected to a second terminal of the storage capacitor (Cs) through the first switching element (11), and a drain connected to a driving power source; the matching TFT (MTFT) has a gate and a drain connected to the gate of the driving TFT (DTFT), and a source connected to the source of the driving TFT (DTFT) through the driving control unit (12); the second terminal of the storage capacitor (Cs) is also connected to a data line through the driving control unit (12).

12 Claims, 7 Drawing Sheets

(56) References Cited

U.S. PATENT DOCUMENTS

| | | | | |
|---|---|---|---|---|
| 2010/0128014 | A1 | 5/2010 | Choi | |
| 2010/0220086 | A1 | 9/2010 | Chung et al. | |
| 2011/0304593 | A1 * | 12/2011 | Huang | G09G 3/3225 345/204 |

OTHER PUBLICATIONS

First Chinese Office Action dated Feb. 26, 2014; Appln. No. 20121004857.3.

International Preliminary Report on Patentability dated Sep. 2, 2014; PCT/CN2012/084010.

* cited by examiner

PIXEL UNIT DRIVING CIRCUIT, PIXEL UNIT DRIVING METHOD AND PIXEL UNIT

FIELD OF THE DISCLOSURE

The present disclosure relates to the technical field of organic light emitting display technology, especially to a pixel unit driving circuit, a pixel unit driving method and a pixel unit.

BACKGROUND

Active Matrix Organic Light Emitting Diode (AMOLED) can emit when being driven by a current generated by a driving Thin-film transistor (TFT) in a saturated state. Because different driving currents will be generated due to different threshold voltages when a same gray scale voltage is put, causing the inconsistency of driving currents. Vth Threshold voltages of transistors Vth of LTPS (Low-temperature Polysilicon) manufacturing process have very bad uniformity, meanwhile. Vth has drifting. The luminance uniformity of such conventional 2T1C circuit has always been bad.

The conventional 2T1C pixel unit driving circuit is shown in FIG. 1. The circuit has only two TFTs, T1 is used as a switch, DTFT is used for driving a pixel. The operation of conventional 2T1C pixel unit driving circuit is also easier. The timing diagram of this 2T1C pixel unit driving circuit is shown in FIG. 2. When a scan level of a scan line Scan is low, T1 is turned on and a gray scale voltage of a data line Data charges a capacitor C. When the scan level is high, T1 is turned off and the capacitor C is used to store the gray scale voltage. Since VDD (voltage outputted from a high level output terminal of a driving power source) is high, DTFT is in a saturated state. A driving current of OLED is $I=K(Vsg-|Vth|)^2=K(VDD-Vdata-|Vth|)^2$, wherein Vsg is difference between voltages at a source and a gate of DTFT, Vdata is the gray scale voltage on the data line Data, K is a constant related to transistor size and carrier mobility, once the TFT size and process is determined, K is determined. The equation of the driving current for this 2T1C pixel unit driving circuit contains Vth. As described above, since the LTPS process is not fully developed, even the process parameters are the same, there is great difference between Vth of the TFTs on different positions of the produced panel, causing the different driving currents under the same gray level voltage. Therefore, under this driving scheme, the luminance of different positions of a panel will differ and the luminance uniformity is bad. At the same time, as the usage of OLED panel extends, OLED material ages, causing the threshold voltage of OLED increase. The emitting efficiency of the OLED material decreases and the brightness of the panel decreases with the same current.

SUMMARY

The main object of the present disclosure is providing a pixel unit driving circuit, a pixel unit driving method and a pixel unit, in order to improve the problems of luminance uniformity of OLED panel and luminance decreasing caused by material aging.

To achieve above objects, the present disclosure provides a pixel unit driving circuit for driving OLED, comprising a driving thin film transistor (TFT), a matching TFT, a first switching element, a storage capacitor and a driving control unit;

said driving TFT has a gate connected to a first terminal of said storage capacitor, a source connected to said OLED and connected to a second terminal of said storage capacitor through said first switching element, and a drain connected to a driving power source;

said matching TFT has a gate and a drain connected to the gate of said driving TFT, and a source connected to the source of said driving TFT through said driving control unit;

the second terminal of said storage capacitor is also connected to a data line through said driving control unit.

In an embodiment, said driving control unit includes a second switching element and a third switching element;

the source of said matching TFT is connected to the source of said driving TFT through said second switching element;

the second terminal of said storage capacitor is connected to said data line through said third switching element.

In an example, the source of said driving TFT is connected to a cathode of said OLED;

the drain of said driving TFT is connected to a low level output terminal of said driving power source;

said driving TFT and said matching TFT are P-type TFTs.

In this example, said first switching element is a first TFT, said second switching element is a second TFT, and said third switching element is a third TFT;

said first TFT has a gate connected to a first control line, a drain connected to the second terminal of said storage capacitor, and a source connected to the source of said driving TFT;

said second TFT has a gate connected to a second control line, a drain connected to the source of said matching TFT, and a source connected to the source of said driving TFT;

said third TFT has a gate connected to said second control line, a drain connected to said data line, and a source connected to the second terminal of said storage capacitor;

said first TFT, said second TFT and said third TFT are P-type TFTs.

In another example, the source of said driving TFT is connected to an anode of said OLED;

the source of said driving TFT is connected to a high level output terminal of said driving power source;

said driving TFT and said matching TFT are n-type TFTs.

In this example, said first switching element is a first TFT, said second switching element is a second TFT, and said third switching element is a third TFT;

said first TFT has a gate connected to a first control line, a drain connected to the second terminal of said storage capacitor, and a source connected to the source of said driving TFT;

said second TFT has a gate connected to a second control line, a drain connected to the source of said matching TFT, and a source connected to the source of said driving TFT;

said third TFT has a gate connected to said second control line, a source connected to said data line, and a drain connected to the second terminal of said storage capacitor;

said first TFT, said second TFT and said third TFT are n-type TFTs.

The present disclosure also provides a pixel unit driving method, which is applied to the above mentioned pixel unit driving circuits, said pixel unit driving method comprises:

a step of pixel charging: the driving control unit controls the storage capacitor to be charged till the voltage level of the gate of the driving TFT increases to a voltage level that is less than the voltage level of the source of the matching TFT by the threshold voltage of the matching TFT. At this moment, said matching TFT is turned off and said driving TFT is turned off;

a step of driving OLED to emit light: the first switching element turns on the connection between the source of the driving TFT and the second terminal of said storage capacitor, said driving TFT is turned on, said driving control unit controls the gate of said driving TFT to be in a floating state, in order to compensate the threshold voltage of said driving TFT by the threshold voltage of said matching TFT.

In one embodiment, there is a buffering step between the step of pixel charging and the step of driving OLED to emitting light, wherein said driving control unit disconnects the connection between the data line and the second terminal of the storage capacitor, and disconnects the connection between the source of the driving TFT and the source of the matching TFT.

The present disclosure also provides a pixel unit, including an OLED and the above mentioned pixel unit driving circuit, the pixel unit driving circuit is connected to the cathode of the OLED;

an anode of the OLED is connected to a high level output terminal of the driving power source.

The present disclosure also provides a pixel unit, including an OLED and the above mentioned pixel unit driving circuit, the pixel unit driving circuit is connected to the anode of the OLED;

a cathode of the OLED is connected to a low level output terminal of the driving power source.

Compared to prior art, the present disclosure utilizes the principle that the electrical property of two same designed TFTs within the same pixel are more matching to compensate the threshold voltage of the driving transistor for driving OLED, meanwhile utilizes voltage feedback to compensate the increasing threshold voltage of OLED caused by OLED material aging, improving the problems of the luminance uniformity of OLED panel and luminance decreasing caused by material aging.

DETAILED DESCRIPTION

The technical solutions in the embodiments of the present disclosure will be described clearly and completely in conjunction with the accompanying drawings of the present disclosure below. Apparently, these described embodiments are only some parts of the embodiments of the present disclosure, rather than all of them. All the other embodiments obtained by the ordinary skilled in the art based on the embodiments given in the present disclosure, without creative modifications, are within the scope of the present disclosure.

Figure 1:
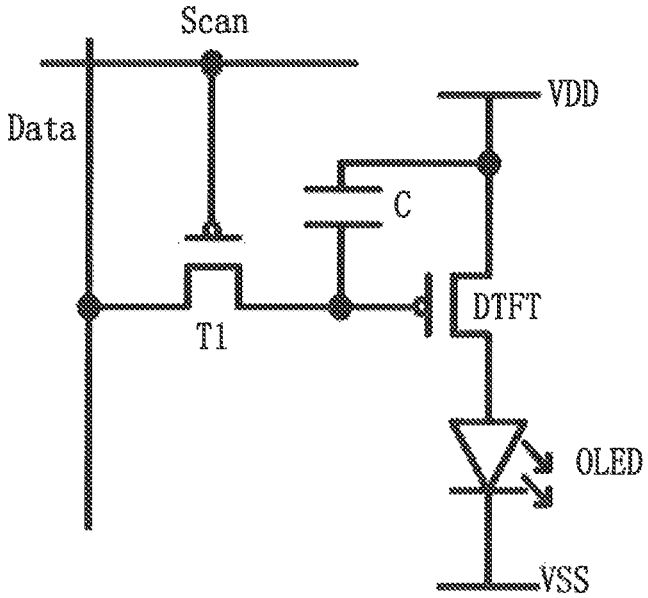
Fig.1 Prior Art
FIG. 1 is a circuit diagram of a conventional 2T1C pixel unit driving circuit.
Figure 2:
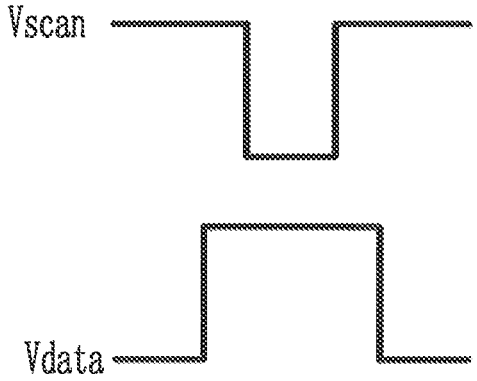
Fig.2 Prior Art
FIG. 2 is a control timing diagram of this conventional 2T1C pixel unit driving circuit.
Figure 3:
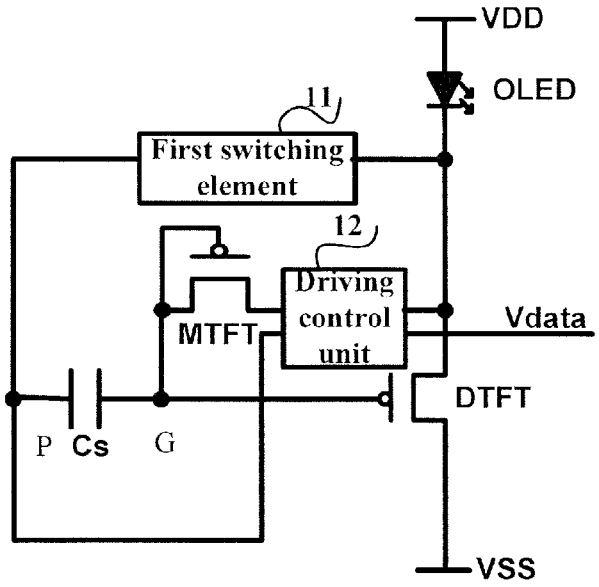
FIG. 3 is a circuit diagram of a pixel unit driving circuit according to a first embodiment of the present disclosure.

As shown in FIG. 3, a pixel unit driving circuit according to a first embodiment of the present disclosure, which is used to drive OLED, includes a driving TFT DTFT, a matching TFT MTFT, a first switching element 11, a storage capacitor Cs and a driving control unit 12;

said driving TFT DTFT has a gate connected to a first terminal of said storage capacitor Cs, a source connected to a second terminal of said storage capacitor through said first switching element 11, a drain connected to a low level output terminal of a driving power source;

said matching TFT MTFT has a gate and a drain connected to the gate of said driving TFT DTFT, a source connected to the source of said driving TFT DTFT through said driving control unit 12;

the second terminal of said storage capacitor Cs is also connected to a data line through said driving control unit 12;

said data line outputs a data voltage Vdata;

said driving TFT DTFT and said matching TFT MTFT are P-type TFTs.

an anode of said OLED is connected to a high level output terminal of said driving power source, a cathode of said OLED is connected to the source of said driving TFT DTFT;

an output voltage of the high level output terminal of said driving power source is VDD, an output voltage of the low level output terminal of said driving power source is VSS;

wherein, a point G is a node connected to the first terminal of said storage capacitor Cs, a point P is a node connected to the second terminal of said storage capacitor Cs.

When the pixel unit driving circuit according to the first embodiment of the present disclosure operates, during a first time period, said driving control unit 12 turns on the connection between the source of MTFT and the source of DTFT, and the connection between the second terminal of the storage capacitor Cs and the data line. Since MTFT is in a diode connection, MFTF is turned on. VDD charges the storage capacitor Cs through OLED and MTFT, so that the voltage level of the point G (that is, the node connected to the gate of DTFT) increases. When the voltage level of the point G becomes as high as a voltage level, which only is less than the voltage level of the source of MFTF by the threshold voltage Vthm of MTFT, MTFT is turned off. Because Vthm=Vthd, DTFT is turned off as well. However, the voltage difference between the anode and the cathode of OLED decreases to Vth_oled due to the loss caused by light emitting of OLED, therefore at this moment, $Vg=VDD-Vth_oled-|Vthm|$ and a voltage across the two terminals of the storage capacitor Cs becomes $Vc=Vg-Vp=VDD-Vth_oled-|Vthm|-Vdata$; wherein Vthd is the threshold voltage of DTFT, Vthm is the threshold voltage of MTFT, Vth_oled is the threshold voltage of OLED, Vg is the voltage level of the point G (the node connected to the first terminal of said storage capacitor), Vp is the voltage level of the point P (the node connected to the second terminal of said storage capacitor).

During a second time period which is a buffering phase, said driving control unit 12 turns off the connection between the source of MTFT and the source of DTFT, and the connection between the second terminal of the storage capacitor Cs and the data line. MTFT is turned off and DTFT is also turned off practically, both being in non-operating state in order not to generate unnecessary interfering signal due to switching of the transistors. At this moment, the voltage across the two terminals of the storage capacitor Cs keeps unchanged, that is, Vc=Vg−Vp=VDD−Vth_oled−|Vthm|−Vdata.

During a third time period, said first switching element 11 turns on the connection between the second terminal of the storage capacitor Cs and the source of said driving TFT DTFT. Because the voltage level of the point P changes from Vdata to VDD−Voled (Voled is the operating voltage of OLED under this gray scale and is different from Vth_oled) and the gate of DTFT is in a floating state, the voltage of Vg changes to Vg=VDD−Vth_oled−|Vthm|+VDD−Voled−Vdata. At this moment, the voltage difference between the source and the gate of DTFT is: Vsg=VDD−Voled−Vg=VDD−Voled−(VDD−Vth_oled−|Vthm|+VDD−Voled−Vdata)=Vdata+Vth_oled+|Vthm|−VDD, so that DTFT operates and a current flowing through DTFT is: $I=K(Vsg-|Vthd|)^2=K(Vdata+Vth_oled+|Vthm|-VDD-|Vthd|)^2$. Since Vthm=Vthd, the current flowing through DTFT is: $I=K(Vdata+Vth_oled-VDD)^2$, OLED starts to emit light till the next frame;

wherein, K is the current coefficient of DTFT;

$$K = C_{ox} \times \mu \times \frac{W}{L};$$

μ, $C_{ox}$, W, L are the carrier mobility of DTFT, gate insulating layer capacitance per unit area, channel width, channel length, respectively;

It is found that the current I and the threshold voltage Vthd of DTFT are not related, therefore, the uniformity of the current could be improved to achieve the uniformity of luminance. And meanwhile, the calculation formula of the current I contains the term of Vth_oled, with the extension of usage, OLED material ages and the emitting efficiency decreases, Vth_oled will increase, and the increasing of Vth_oled causes the operating current to increase accordingly, so that it improves the decreasing of panel luminance caused by material aging.

Figure 4:
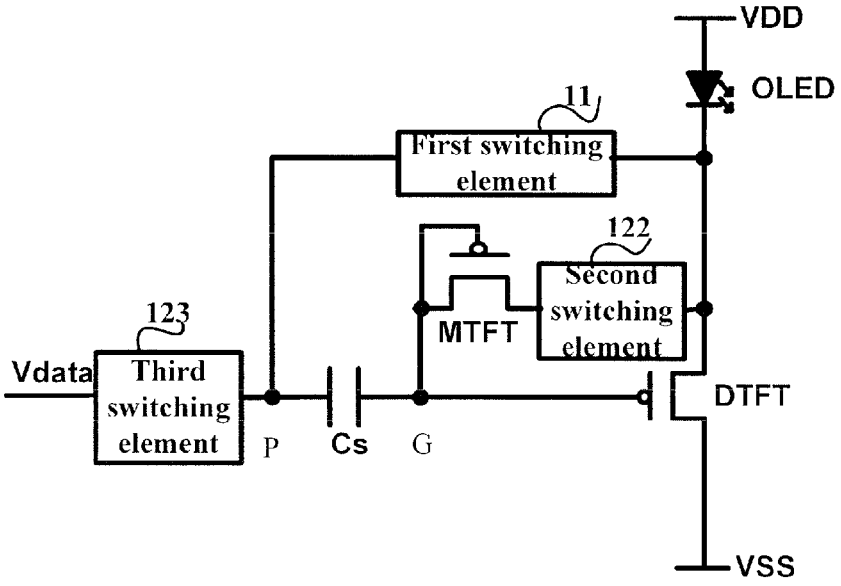
FIG. 4 is a circuit diagram of a pixel unit driving circuit according to a second embodiment of the present disclosure.

As shown in FIG. 4, a circuit diagram of a pixel unit driving circuit according to a second embodiment of the present disclosure is shown. The pixel unit driving circuit according to the second embodiment of the present disclosure is based on the pixel unit driving circuit according to the first embodiment of the present disclosure.

In the pixel unit driving circuit according to the second embodiment of the present disclosure, said driving control unit 12 includes a second switching element 122 and a third switching element 123;

the source of said matching TFT MTFT is connected to the source of said driving TFT DTFT through said second switching element 122;

the second terminal of said storage capacitor Cs is connected to said data line through said third switching element 123;

an output voltage of the high level output terminal of said driving power source is VDD, an output voltage of the low level output terminal of said driving power source is VSS;

wherein, a point G is a node connected to the first terminal of said storage capacitor, a point P is a node connected to the second terminal of said storage capacitor.

Figure 5:
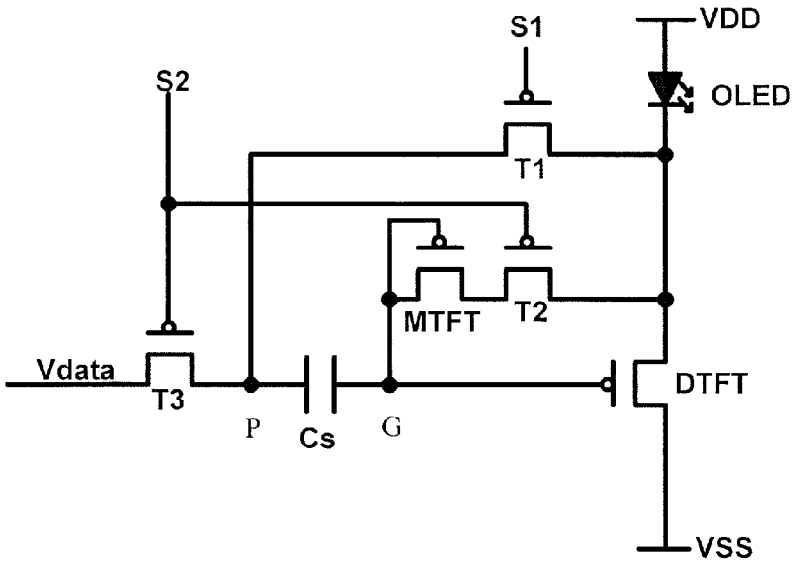
FIG. 5 is a circuit diagram of a pixel unit driving circuit according to a third embodiment of the present disclosure.

As shown in FIG. 5, a circuit diagram of a pixel unit driving circuit according to a third embodiment of the present disclosure is shown. The pixel unit driving circuit according to the third embodiment of the present disclosure is based on the pixel unit driving circuit according to the second embodiment of the present disclosure.

In the pixel unit driving circuit according to the third embodiment of the present disclosure, said first switching element is a first TFT marked as T1, said second switching element 122 is a second TFT marked as T2, said third switching element 123 is a third TFT marked as T3;

said first TFT T1 has a gate connected to a first control line which outputs a first control signal S1, a drain connected to the second terminal of said storage capacitor Cs, and a source connected to the source of said driving TFT DTFT;

said second TFT T2 has a gate connected to a second control line which outputs a second control signal S2, a drain connected to the source of said matching TFT MTFT, and a source connected to the source of said driving ITT DTFT;

said third TFT T3 has a gate connected to the second control line, a drain connected to said data line, and a source connected to the second terminal of said storage capacitor;

all of said first TFT T1, said second TFT T2, said third TFT T3, said matching TFT MTFT and said driving TFT DTFT are p-type TFTs;

an output voltage of the high level output terminal of said driving power source is VDD, an output voltage of the low level output terminal of said driving power source is VSS;

wherein, a point G is a node connected to the first terminal of said storage capacitor, a point P is a node connected to the second terminal of said storage capacitor.

Figure 6:
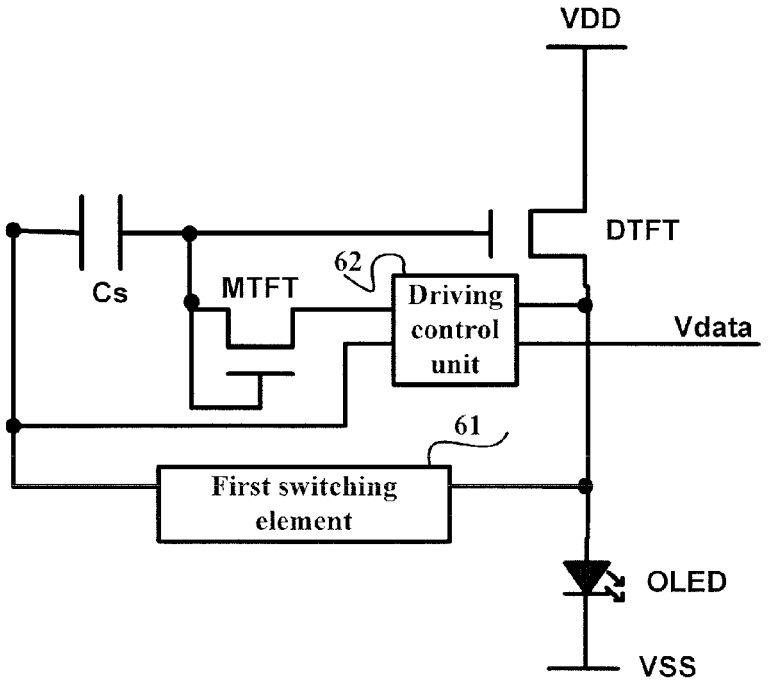
FIG. 6 is a circuit diagram of a pixel unit driving circuit according to a forth embodiment of the present disclosure.

As shown in FIG. 6, a pixel unit driving circuit according to a fourth embodiment of the present disclosure, which is used for driving OLED, includes a driving TFT DTFT, a matching TFT MTFT, a first switching element 61, a storage capacitor Cs and a driving control unit 62;

said driving TFT DTFT has a gate connected to a first terminal of said storage capacitor Cs, a source connected to an anode of OLED and to a second terminal of said storage capacitor Cs through said first switching element 61, and a drain connected to a high level output terminal of a driving power source;

said matching TFT MTFT has a gate and a drain connected to the gate of said driving TFT DTFT, and a source connected to the source of said driving TFT DTFT through said driving control unit 62;

the second terminal of said storage capacitor Cs is also connected to a data line through said driving control unit 62;

said data line outputs a data voltage Vdata;

a cathode of said OLED is connected to a low level output terminal of said driving power source;

said driving TFT DTFT and said matching TFT MTFT are n-type TFTs;

an output voltage of the high level output terminal of said driving power source is VDD, an output voltage of the low level output terminal of said driving power source is VSS.

Figure 7:
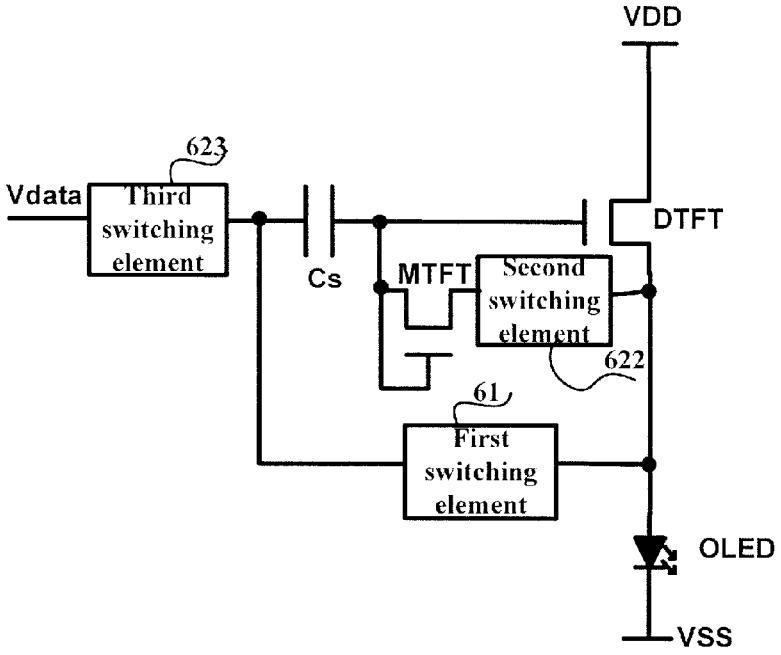
FIG. 7 is a circuit diagram of a pixel unit driving circuit according to a fifth embodiment of the present disclosure.

As shown in FIG. 7, a circuit diagram of a pixel unit driving circuit according to a fifth embodiment of the present disclosure is shown. The pixel unit driving circuit according to the fifth embodiment of the present disclosure is based on the pixel unit driving circuit according to the fourth embodiment of the present disclosure.

In the pixel unit driving circuit according to the fifth embodiment of the present disclosure, said driving control unit 62 includes a second switching element 622 and a third switching element 623;

the source of said matching TFT MTFT is connected to the source of said driving TFT DTFT through said second switching element 622;

the second terminal of said storage capacitor Cs is connected to said data line through said third switching element 623;

an output voltage of the high level output terminal of said driving power source is VDD, an output voltage of the low level output terminal of said driving power source is VSS.

Figure 8:
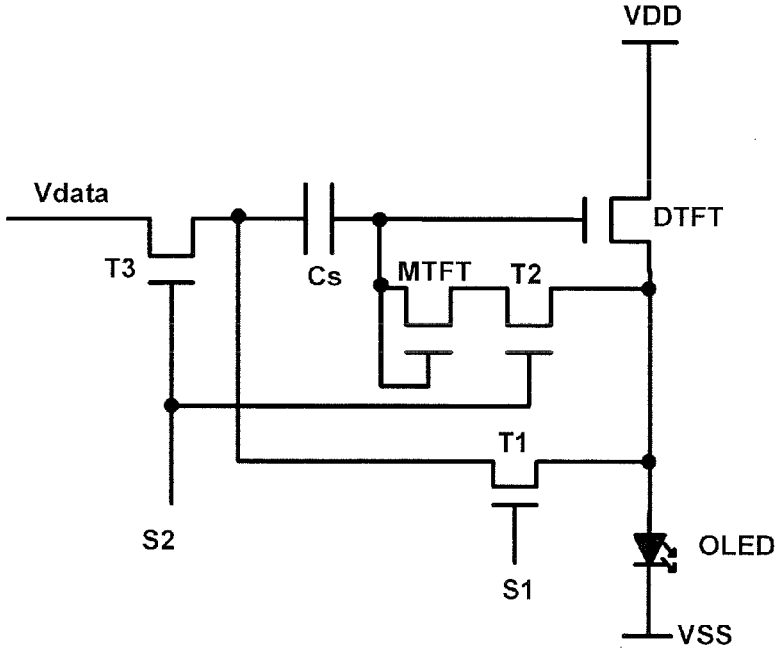
FIG. 8 is a circuit diagram of a pixel unit driving circuit according to a sixth embodiment of the present disclosure.

As shown in FIG. 8, a circuit diagram of a pixel unit driving circuit according to a sixth embodiment of the present disclosure is shown. The pixel unit driving circuit according to the sixth embodiment of the present disclosure is based on the pixel unit driving circuit according to the fifth embodiment of the present disclosure.

In the pixel unit driving circuit according to the sixth embodiment of the present disclosure, said first switching element 61 is a first TFT marked as T1, said second switching element 622 is a second TFT marked as T2, said third switching element 623 is a third TFT marked as T3;

said first TFT T1 has a gate connected to a first control line, a drain connected to the second terminal of said storage capacitor Cs, and a source connected to the source of said driving TFT DTFT;

said second TFT T2 has a gate connected to a second control line, a drain connected to the source of said matching TFT MTFT, and a source connected to the source of said driving TFT DTFT;

said third TFT T3 has a gate connected to the second control line, a source connected to the data line, and a drain connected to the second terminal of said storage capacitor Cs;

all of the said first TFT T1, said second TFT T2, said third TFT T3 are n-type TFTs;

an output voltage of the high level output terminal of said driving power source is VDD, an output voltage of the low level output terminal of said driving power source is VSS.

Figure 9:
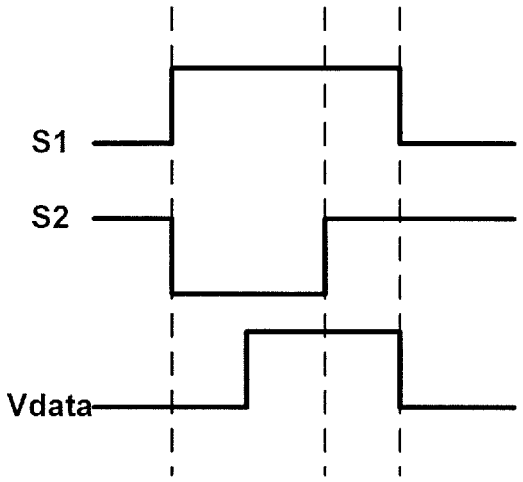
FIG. 9 is timing diagrams of various signals of the pixel unit driving circuit according to the third embodiment of the present disclosure in operation.
Figure 10A:
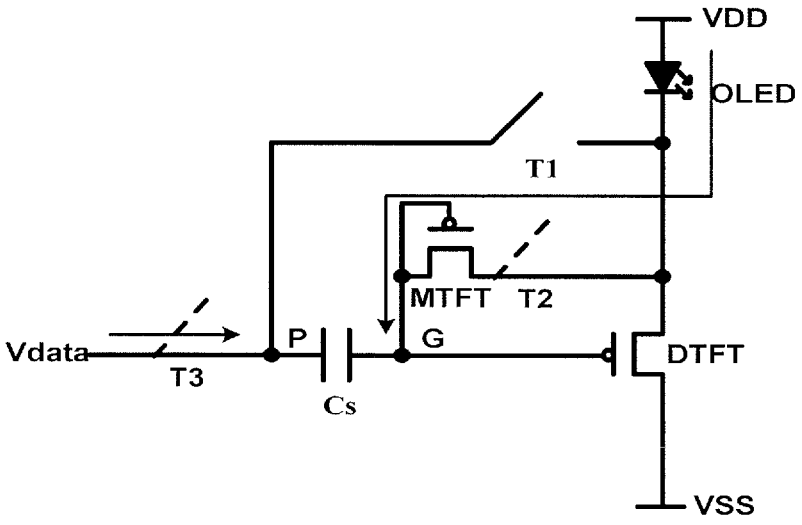
FIG. 10A is a equivalent circuit diagram of the pixel unit driving circuit according to the third embodiment of the present disclosure during a first time period.
Figure 10B:
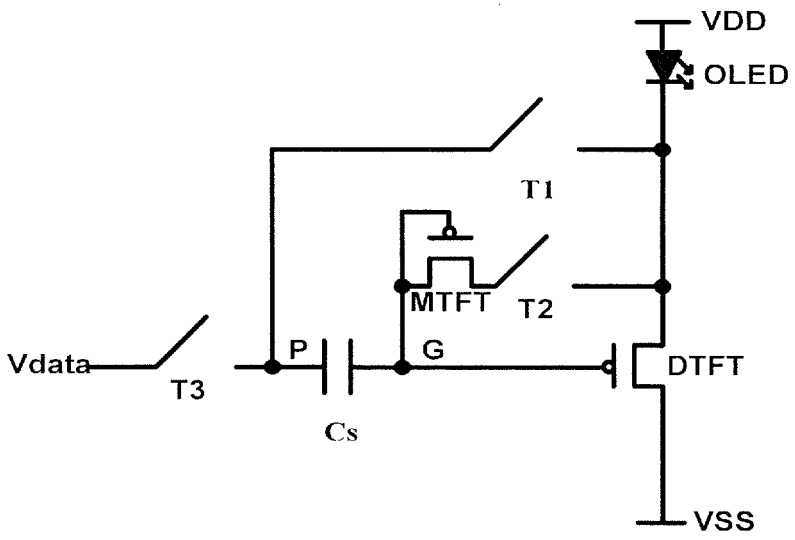
FIG. 10B is a equivalent circuit diagram of the pixel unit driving circuit according to the third embodiment of the present disclosure during a second time period.
Figure 10C:
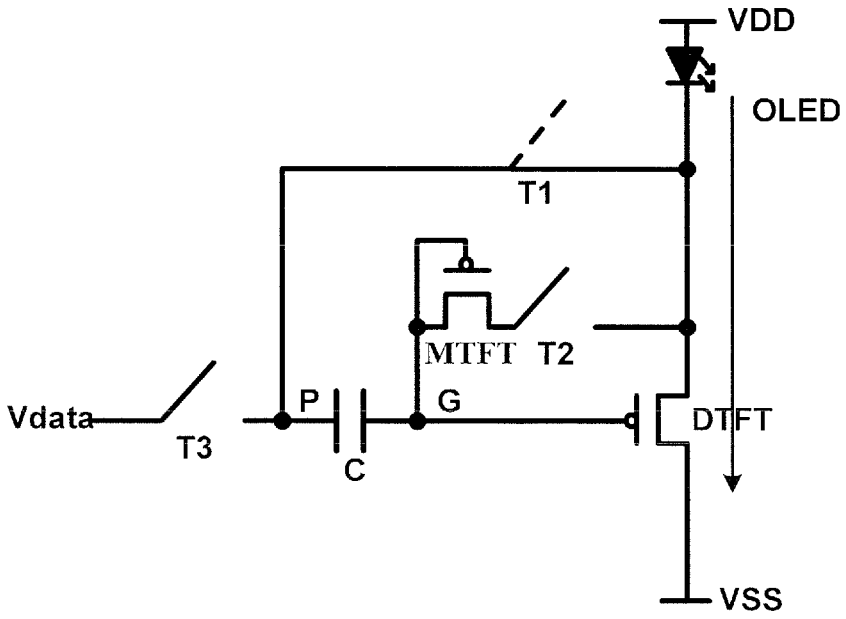
FIG. 10C is a equivalent circuit diagram of the pixel unit driving circuit according to the third embodiment of the present disclosure during a third time period.

Below the operating process of the pixel unit driving circuit according to the third embodiment of the present disclosure as shown in FIG. 5 will be introduced:

As shown in FIG. 9, the timing diagrams of the first control signal S1, the second control signal S2 and the output signal Vdata of said data line are shown;

FIG. 10A is a equivalent circuit diagram of the pixel unit driving circuit according to the third embodiment of the present disclosure during the first time period;

FIG. 10B is a equivalent circuit diagram of the pixel unit driving circuit according to the third embodiment of the present disclosure during the second time period;

FIG. 10C is a equivalent circuit diagram of the pixel unit driving circuit according to the third embodiment of the present disclosure during the third time period.

As shown in FIG. 10A, during the first time period, which is the starting phase, T2 and T3 are turned on, T1 is turned off. Since T3 is turned on, Vdata (for the pixel unit driving circuit, relatively great voltage Vdata is needed, usually the varying range of Vdata is greater than VDD) is inputted; since MTFT is in a diode connection, MTFT is turned on; VDD charges the storage capacitor Cs through OLED and MTFT, so that the voltage level of the point G (that is, the node connected to the gate of DTFT) increases. When the voltage level of the point G is as high as a voltage level, which is only less than the voltage level of the source of MFTF by the threshold voltage Vthm of MTFT, MTFT is turned off. Because Vthm=Vthd, DTFT is turned off as well. However, the voltage difference between the anode and the cathode of OLED decrease to Vth_oled due to the loss caused by light emitting of OLED, therefore at this moment, Vg=VDD−Vth_oled−|Vthm|, the voltage across the two terminals of the storage capacitor Cs becomes Vc=Vg−Vp=VDD−Vth_oled−|Vthm|−Vdata; wherein Vthd is the threshold voltage of DTFT, Vthm is the threshold voltage of MTFT, Vth_oled is the threshold voltage of OLED, Vg is the voltage level of the point G (the node connected to the first terminal of said storage capacitor), Vp is the voltage level of the point P (the node connected to the second terminal of said storage capacitor).

As shown in FIG. 10B, during the second time period, which is a buffering phase, T1, T2 and T3 are all turned off, and actually MTFT and DTFT are also turned off, being in non-operating state in order not to generate unnecessary interfering signal due to switching of the transistors. At this moment, the voltage across the two terminals of the storage capacitor Cs keeps unchanged, that is, Vc=Vg−Vp=VDD−Vth_oled−|Vthm|−Vdata.

As shown in FIG. 10C, during the third time period, T1 is turned on, T2 and T3 are turned off. Because the voltage level of the point P changes from Vdata to VDD−Voled (Voled is the operating voltage of OLED under this gray scale and is different from Vth_oled) and the gate of DTFT is in a floating state, the voltage of Vg changes to Vg=VDD−Vth_oled−|Vthm|+VDD−Voled−Vdata. At this moment, the voltage difference between the source and the gate of DTFT is: Vsg=VDD−Voled−Vg=VDD−Voled−(VDD−Vth_oled−|Vthm|+VDD−Voled−Vdata)=Vdata+Vth_oled+|Vthm|−VDD, so that DTFT is turned on and a current flowing through DTFT is: $I=K(Vsg-|Vthd|)^2=K(Vdata+Vth_oled+|Vthm|-VDD-|Vthd|)^2$. Since Vthm=Vthd, the current flowing through DTFT is: $I=K(Vdata+Vth_oled-VDD)^2$, OLED starts to emit light till the next frame;

wherein, K is the current coefficient of DTFT;

$$K = C_{ox} \times \mu \times \frac{W}{L};$$

μ, $C_{ox}$, W, L are the carrier mobility of DTFT, gate insulating layer capacitance per unit area, channel width, channel length, respectively.

It is found that the current I and the threshold voltage Vthd of DTFT are not related, therefore, the uniformity of the current could be improved to achieve the uniformity of luminance. And meanwhile, the calculation formula of the current I contains the term of Vth_oled, with the extension of usage, OLED material ages and the emitting efficiency decreases, Vth_oled will increase, and the increasing of Vth_oled causes the operating current to increase accordingly, so that it improves the decreasing of panel luminance caused by material aging.

Figure 11:
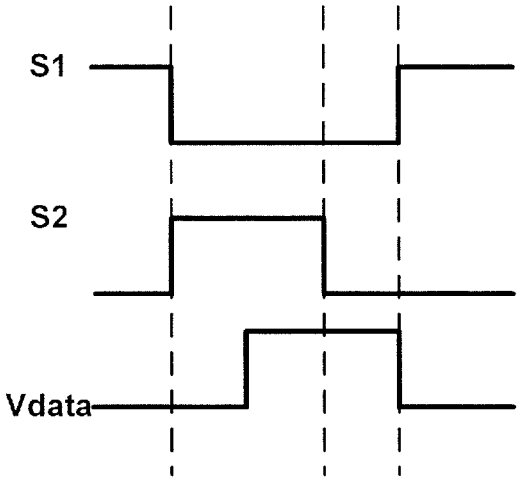
FIG. 11 is timing diagrams of various signals of the pixel unit driving circuit according to the sixth embodiment of the present disclosure in operation.

As shown in FIG. 11, the timing diagrams of the first control signal S1, the second control signal S2 and the output signal Vdata of said data line when the pixel unit driving circuit according to the sixth embodiment of the present disclosure is in operation are shown.

Comparing the pixel unit driving circuit according to the sixth embodiment of the present disclosure to the pixel unit driving circuit according to the third embodiment of the present disclosure, it is found that: all of the TFTs are replaced by n-type TFTs, the cathode of OLED and the anode of OLED are interchanged and the voltage levels in the corresponding timing diagrams are inversed. However, the operating processes are the same.

The prominent characteristic of the pixel unit driving circuits according to the embodiments of the present disclosure is that, it utilizes the principle that the electrical property of two same designed TFTs within a same pixel are more matching to compensate the threshold voltage of the driving transistor for driving OLED (because the positions of two same designed TFTs within a same pixel are very close to each other, the process circumstances for the two same designed TFTs are the same even under the existing process condition not fully developed, the differences in the electrical property caused by the process are very small and could be considered as equivalent, that is, the threshold voltage Vthm of the matching TFT is the same as the threshold voltage Vthd of the driving TFT DTFT), and meanwhile it utilizes voltage feedback to compensate the increasing threshold voltage of OLED caused by OLED material aging.

The present disclosure also provides a pixel unit driving method, which is applied to the above mentioned pixel unit driving circuits, said pixel unit driving method comprises:

a step of pixel charging: the driving control unit controls the storage capacitor to be charged till the voltage level of the gate of the driving TFT increases to a voltage level that is less than the voltage level of the source of the matching TFT by the threshold voltage of the matching TFT. At this moment, said matching TFT is turned off and said driving TFT is turned off;

a step of driving OLED to emit light: the first switching element turns on the connection between the source of the driving TFT and the second terminal of said storage capacitor, said driving TFT is turned on, said driving control unit controls the gate of said driving TFT to be in a floating state, in order to compensate the threshold voltage of said driving TFT by the threshold voltage of said matching TFT.

In one embodiment, there is a buffering step between the step of pixel charging and the step of driving OLED to emitting light, wherein said driving control unit disconnects the connection between the data line and the second terminal of the storage capacitor, and disconnects the connection between the source of the driving TFT and the source of the matching TFT.

The present disclosure also provides a pixel unit, including OLED and the pixel unit driving circuit according to the first embodiment, the second embodiment or the third embodiment;

the source of the driving TFT included in said pixel unit driving circuit is connected to the cathode of said OLED, the drain of said driving TFT is connected to the low level output terminal of the driving power source, the anode of said OLED is connected to the high level output terminal of the driving power source.

The present disclosure also provides a pixel unit, including OLED and the pixel unit driving circuit according to the fourth embodiment, the fifth embodiment or the sixth embodiment;

The source of the driving TFT included in said pixel unit driving circuit is connected to the anode of said OLED, the drain of said driving TFT is connected to the high level output terminal of the driving power source, the cathode of said OLED is connected to the low level output terminal of the driving power source.

What needs to be explained is that, the manufacturing processes of the source s and the drain g of above mentioned TFTs (including TFTs as switching elements, driving TFTs and matching TFTs) are the same, their names are exchangeable and could be changed according to the direction of the voltage. Moreover, the types of various transistors within one pixel circuit could be the same or not, and it needs to adjust the high and low voltage level of the corresponding timing sequence of a gate starting signal source according to the properties of threshold voltage of various transistors. Of course, the preferable manner is the types of transistors, which need the same gate starting signal source, are the same. Even more preferable, all the TFTs within the same pixel circuit are the same (including TFTs as switching elements, driving TFTs and matching TFTs), that is, all of the TFTs are n-type TFTs or all of the TFTs are p-type TFTs.

All above is only illustrative for the present disclosure, not by the way of restriction. It will be understood by the skilled in the art that, many modifications, alternations or equivalents can be made without departing from the spirit and scope defined by appended claims, and are all within the protection of the present disclosure.

What is claimed is:

1. A pixel unit driving circuit for driving OLED, including: a driving thin Film Transistor TFT, a matching TFT, a first switching element, a storage capacitor and a driving control unit; wherein the driving control unit includes a second switching element and a third switching element, the first switching element, the second switching element and the third switching element are different from each other, the driving TFT has a gate connected to a first terminal of the storage capacitor, a source connected to the OLED and connected to a second terminal of the storage capacitor through the first switching element, and a drain connected to a driving power source;

the matching TFT has a gate and a drain connected to the gate of the driving TFT, and a source connected to the source of the driving TFT through the second switching unit; and the second terminal of the storage capacitor is also connected to a data line through the third switching unit.

2. The pixel unit driving circuit according to claim 1, wherein the source of the driving TFT is connected to a cathode of the OLED;

the drain of the driving TFT is connected to a low level output terminal of the driving power source; and the driving TFT and the matching TFT are P-type TFTs.

3. The pixel unit driving circuit according to claim 2, wherein, the first switching element is a first TFT, the second switching element is a second TFT, the third switching element is a third TFT;

the first TFT has a gate connected to a first control line, a drain connected to the second terminal of the storage capacitor, and a source connected to the source of the driving TFT;

the second TFT has a gate connected to a second control line, a drain connected to the source of the matching TFT, and a source connected to the source of the driving TFT;

the third TFT has a gate connected to the second control line, a drain connected to the data line, and a source connected to the second terminal of the storage capacitor;

the first TFT, the second TFT and the third TFT are all p-type TFTs.

4. The pixel unit driving circuit according to claim 1, wherein, the source of the driving TFT is connected to an anode of the OLED;

the drain of the driving TFT is connected to a high level output terminal of the driving power source;

the driving TFT and the matching TFT are n-type TFTs.

5. The pixel unit driving circuit according to claim 4, wherein, the first switching element is a first TFT, the second switching element is a second TFT, the third switching element is a third TFT;

the first TFT has a gate connected to a first control line, a drain connected to the second terminal of the storage capacitor, and a source connected to the source of the driving TFT;

the second TFT has a gate connected to a second control line, a drain connected to the source of the matching TFT, and a source connected to the source of the driving TFT;

the third TFT has a gate connected to the second control line, a source connected to the data line, and a drain connected to the second terminal of the storage capacitor;

the first TFT, the second TFT and the third TFT are all n-type TFTs.

6. A pixel unit driving method, applied to the pixel unit driving circuit according to claim 1, including the steps of:

a step of pixel charging: the second switching unit is turned on to control the storage capacitor to be charged till the voltage level of the gate of the driving TFT increases to a voltage level that is less than the voltage level of the source of the matching TFT by the threshold voltage of the matching TFT, at this moment, the matching TFT is turned off and the driving TFT is turned off;

a step of driving OLED to emit light: the first switching element turns on the connection between the source of the driving TFT and the second terminal of the storage capacitor, the driving TFT is turned on, the second switching unit is turned off to control the gate of the driving TFT to be in a floating state, in order to compensate the threshold voltage of the driving TFT by the threshold voltage of the matching TFT.

7. The pixel unit driving method according to claim 6, wherein, there is also a buffering step between the step of pixel charging and the step of driving OLED to emit light: the third switching unit is turned off to disconnect the connection between the data line and the second terminal of the storage capacitor, and the second control unit is turned off to disconnects the connection between the source of the driving TFT and the source of the matching TFT.

8. A pixel unit including an OLED and a pixel unit driving circuit for driving OLED, the pixel unit driving circuit including: a driving thin Film Transistor TFT, a matching TFT, a first switching element, a storage capacitor and a driving control unit; wherein the driving control unit includes a second switching element and a third switching element, the first switching element, the second switching element and the third switching element are different from each other, the driving TFT has a gate connected to a first terminal of the storage capacitor, a source connected to the OLED and connected to a second terminal of the storage capacitor through the first switching element, and a drain connected to a driving power source;

the matching TFT has a gate and a drain connected to the gate of the driving TFT, and a source connected to the source of the driving TFT through the second switching unit; and the second terminal of the storage capacitor is also connected to a data line through the third switching unit.

9. The pixel unit according to claim 8, wherein the source of the driving TFT in the pixel unit driving circuit is connected to a cathode of the OLED;

an anode of the OLED is connected to a high level output terminal of the driving power source;

the drain of the driving TFT is connected to a low level output terminal of the driving power source; and the driving TFT and the matching TFT are P-type TFTs.

10. The pixel unit according to claim 9, wherein, the first switching element is a first TFT, the second switching element is a second TFT, the third switching element is a third TFT;

the first TFT has a gate connected to a first control line, a drain connected to the second terminal of the storage capacitor, and a source connected to the source of the driving TFT;

the second TFT has a gate connected to a second control line, a drain connected to the source of the matching TFT, and a source connected to the source of the driving TFT;

the third TFT has a gate connected to the second control line, a drain connected to the data line, and a source connected to the second terminal of the storage capacitor;

the first TFT, the second TFT and the third TFT are all p-type TFTs.

11. The pixel unit according to claim 8, wherein, the source of the driving TFT in the pixel unit driving circuit is connected to an anode of the OLED;

a cathode of the OLED is connected to a low level output terminal of the driving power source;

the drain of the driving TFT is connected to a high level output terminal of the driving power source;

the driving TFT and the matching TFT are n-type TFTs.

12. The pixel unit according to claim 11, wherein, the first switching element is a first TFT, the second switching element is a second TFT, the third switching element is a third TFT;

the first TFT has a gate connected to a first control line, a drain connected to the second terminal of the storage capacitor, and a source connected to the source of the driving TFT;

the second TFT has a gate connected to a second control line, a drain connected to the source of the matching TFT, and a source connected to the source of the driving TFT;

the third TFT has a gate connected to the second control line, a source connected to the data line, and a drain connected to the second terminal of the storage capacitor;

the first TFT, the second TFT and the third TFT are all n-type TFTs.

* * * * *